United States Patent [19]

Diggs

[11] 4,051,614

[45] Oct. 4, 1977

[54] HIGH CAPACITY LOADER BLADE

[76] Inventor: Richard E. Diggs, P.O. Box 776, S. 12A Road, Carthage, Mo. 64836

[21] Appl. No.: 626,448

[22] Filed: Oct. 28, 1975

[51] Int. Cl.[2] ..... E02F 3/82; E02F 3/70

[52] U.S. Cl. ..... 37/117.5; 37/118 R; 37/118 A; 37/DIG. 2; 214/146 E; 214/510; 214/767

[58] Field of Search ..... 214/145 R, 146 R, 146 E, 214/767, 510, 140; 37/117.5, 118 R, 118 A, 118 E, DIG. 2; 172/801, 802

[56] References Cited

U.S. PATENT DOCUMENTS

| | | | |
|---|---|---|---|
| 2,455,160 | 11/1948 | Burrow | 37/118 A |
| 2,683,542 | 7/1954 | Baker | 214/767 |
| 2,816,676 | 12/1957 | Avery et al. | 37/117.5 X |
| 2,858,035 | 10/1958 | Mettetal, Jr. | 214/767 |
| 3,077,999 | 2/1963 | Suoboda | 214/145 |
| 3,092,920 | 6/1963 | Benno | 37/117.5 |
| 3,209,474 | 10/1965 | Artman | 214/146 R |
| 3,738,030 | 6/1973 | Olinger | 37/117.5 |
| 3,765,490 | 10/1973 | Logue | 37/118 R X |
| 3,872,986 | 3/1975 | Campbell | 214/146 E |

FOREIGN PATENT DOCUMENTS

| | | | |
|---|---|---|---|
| 919,219 | 2/1963 | United Kingdom | 214/767 |
| 915,640 | 1/1963 | United Kingdom | 37/117.5 |

*Primary Examiner*—Edgar S. Burr
*Assistant Examiner*—Steven A. Bratlie
*Attorney, Agent, or Firm*—Fishburn, Gold & Litman

[57] ABSTRACT

A dozer blade with loading capabilities includes a curved plate or blade for cutting into the soil and to which is secured a pair of laterally spaced arms pivotally supporting a rotatable assembly comprising a load plate extending generally radially from the pivot point to a position where it sweeps the contacting surface of the blade. Opposed radial side plates rotate into soil retaining positions at the sides of the blade when the load plate has rotated upwardly and forwardly of the pivot point. A prime mover is provided to rotate the load plate when desired, aiding in the full discharge of soil carried on the blade.

6 Claims, 3 Drawing Figures

HIGH CAPACITY LOADER BLADE

This invention relates to earth moving equipment and more particularly, to a dozer blade also having both loading and discharge capabilities.

Many types of specialized earth moving devices in the nature of dozer blades and loader buckets are known, however, most tend to have highly restricted functions and are relatively inefficient for other purposes. Loader buckets are satisfactory for receiving relatively loose soil and other materials but often fail to operate satisfactorily for scraping or pushing large quantities of soil or other materials from place to place. Dozer blades are designed for leveling by pushing quantities of materials in front of the blade but generally requires substantial driving force due to the high or obtuse angle which tends to shear rather than cut the soil. Also, dozer blades do not easily handle the lifting and movement of loads from place to place. Various loaders have been developed which somewhat improve operations by providing forced unloading features but most are inordinately complex and therefore expensive and susceptible to malfunction.

The principal objects of this invention are: to provide a combination dozer blade and loader or bucket which operates efficiently in both functions; to provide such an arrangement which is capable of receiving and supporting an extremely large load in relation to its size; to provide such a high capacity tractor tool which has relatively low power requirements for cutting into soil; to provide such an arrangement which is relatively simple and inexpensive in construction and use; and to provide such a bucket-blade combination which is long-lived and extremely well suited for its intended purpose.

Other objects and advantages of this invention will become apparent from the following description taken in connection with the accompanying drawings wherein are set forth, by way of illustration and example, certain embodiments of this invention. The drawings constitute part of the specification and include an exemplary embodiment of the present invention and illustrate various objects and features of the loader blade.

Figure 1:
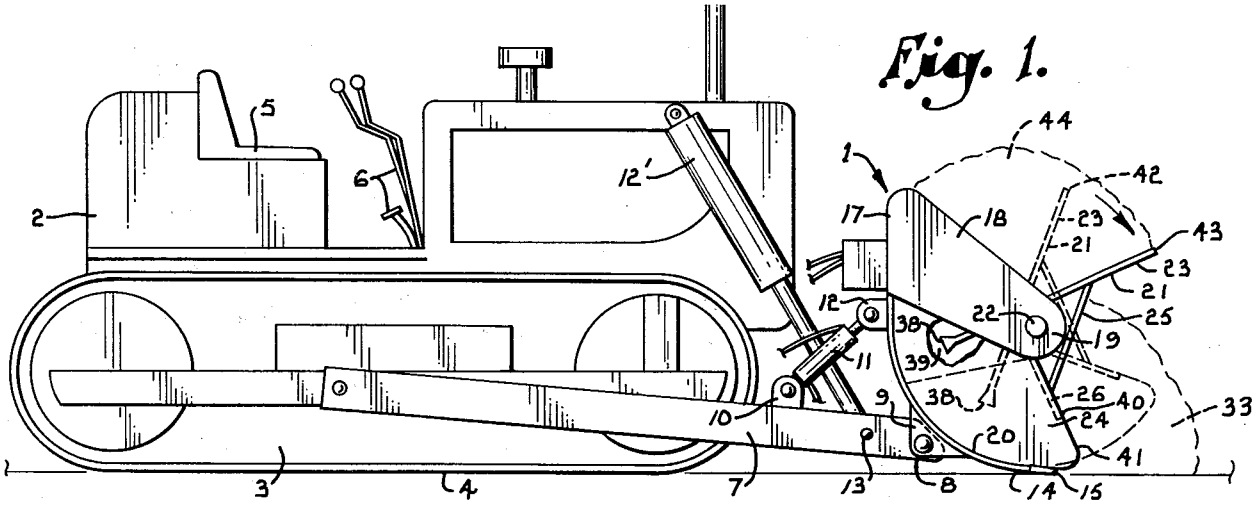
FIG. 1 is a partially schematic side elevation showing one type of typical tractor having the loader blade of this invention operatively mounted on a forwardly extending boom with a load of soil therein indicated partially by broken lines.
Figure 2:
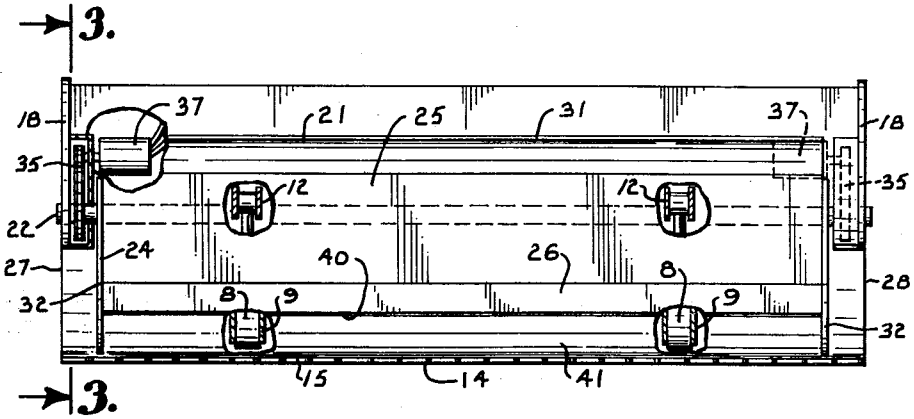
FIG. 2 is a front elevational view showing the loader blade of FIG. 1 but without soil therein.

Referring to the drawings in more detail:

The reference numeral 1 generally indicates a loader blade arrangement embodying this invention. The arrangement 1 is illustrated as mounted on a tractor 2, in this example, a track-laying type having an elongated tractor body 3 carried on a pair of side tracks, one of which is shown at 4. The tractor 2 is controlled from an operator's station 5 through suitable conventional controls 6. Positioned on the tractor frame 3 is a supporting framework composed of a pair of laterally spaced, forwardly extending booms 7 having free ends 8 to which is pivotally mounted brackets 9 of the loader blade arrangement 1 for pivoting in a vertical plane.

A mounting ear 10 projects, in this example, upwardly from the respective booms 7 from a position spaced rearwardly of the forward ends 8. The ears 10 pivotally receive one end respectively of a pair of hydraulic cylinders 11, the other end of which is pivotally secured to a rearwardly directed bracket 12 on the loader blade arrangement 1 which brackets are spaced normally upwardly and rearwardly of the brackets 9. Hydraulic cylinders 12' are conventionally pivotally secured at one end thereof to the tractor 2 and at the other end to a mount 13 on the boom 7 between the forward ends 8 and mounting ears 10. By suitable manipulation of the controls 6, an operator may simultaneously control the elevation and attitude of the loader blade arrangement 1 while the tractor 2 is moved over the terrain.

Although a crawler-type tractor has been described, it is to be understood that wheel-type devices and semi-crawlers may also be utilized in carrying and manipulating the loader blade arrangement now described in detail.

Figure 3:
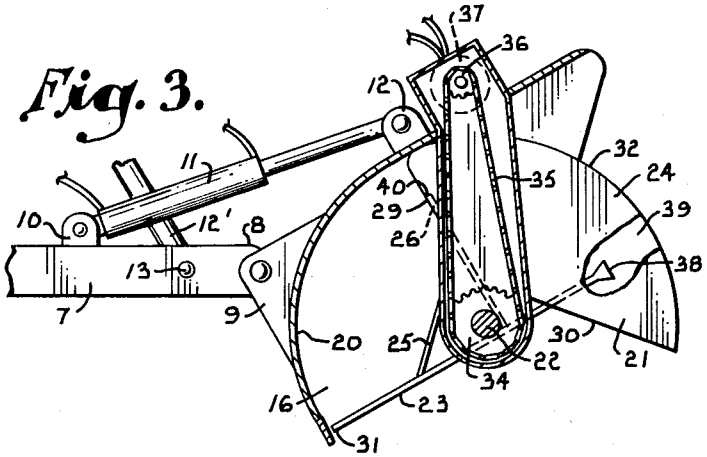
FIG. 3 is a fragmentary side elevation with parts broken away and showing the loader blade arrangement immediately after full discharge of the contents.

The loader blade arrangement 1 is composed of a curved blade 14 having a suitable cutting or slicing edge 15 at the lower end, but having no rigid covering at the sides as best illustrated at 16, FIG. 3. The blade 14, while in the attitude shown in FIG. 1, curves rearwardly and upwardly, generally cylindrically, to an approximately vertical rear section 17 where lateral arms 18 are secured and which project forwardly and downwardly to a position coincident with the tranverse axis of curvature 19 of the blade inner surface 20.

A loading assembly 21 is supported on a shaft 22 which is pivotally mounted on and between the lateral arms 18 and comprises a load plate 23, side plates 24, brace plate 25 and secondary plate 26, the latter extending at an angle of approximately 90° to said load plate 23. The side plates 24 are located in generally parallel planes extending transversely to the shaft 22 and close to the opposite ends 27 and 28 of the curved blade 14. The load plate 23 is contained in a plane generally parallel to the shaft 22 and extends approximately radially or tangentially therefrom in a direction opposite to that of the side plates 24, as best seen in FIG. 3. The side plates 24, in this example, are included within an angle of approximately 130° between leading and trailing edges 29 and 30, however, this angle is not critical. The brace plate 25 and secondary plate 26 help maintain a rigid or fixed relationship between the side plates 24 and load plate 23, whereby the loading assembly 21 may rotate as a single unit with the shaft 22.

The load plate 23 has a free edge 31 located in close relationship to the blade inner surface 20 whereby the rotation of the loading assembly 21 generally sweeps the surface to insure the dislodging of mud or debris which would otherwise adhere thereto. The side plates 24 have a curved circumferential edge 32 which is formed on a radius only slightly less than that of the blade inner surface 20 whereby the edges 32 move in close proximity and conformation with the blades inner surface 20. Thus, the side plates 24, when in the position shown in FIG. 1, effectively restrict the lateral movement of soil 33 off the curved blade ends 27 and 28.

The shaft 22 carries, near opposed ends thereof, sprockets 34 engaged with drive chains 35 which, in turn, engage sprockets 36 mounted on respective hydraulic gear motors 37. The operation of the motors 37 result in the rotation of the loading assembly 21 with respect to the curved blade 14.

The load plate 23 extends generally radially across the shaft 22, terminating in a transverse edge 38 spaced inwardly a substantial distance from the side plate circumferential edges 32 and blade inner surface 20 providing a generous material receiving throat or opening 39 therebetween. Likewise, the secondary plate 26 ends at an outer edge 40 spaced from the blade inner surface 20, leaving a material receiving throat or opening 41.

In operation, the loader blade arrangement 1 is lowered into the ground with the loading assembly 21 preferably, but not necessarily, blocked in the position 42 shown by the appropriate broken lines in FIG. 1. The blade 14 is driven forwardly, cutting into the ground at a desired angle, such as 3° to 7° as dictated by the type and condition of soil encountered. The blade is maintained at a depth which permits the tractor to be continually moved forwardly. As the soil fills the space in front of the blade inner surface 20, the assembly 21 is allowed to drift to the position 43 where the side plates 24 restrict spill over the blade ends 27 and 28. The blade continues to fill to a point where a considerable portion of the soil rests on the upper surface of the load plate 23, as shown at 44, FIG. 1. The extension of the load plate 23 which terminates in the edge 38, coupled with the secondary plate 26, restrict loose dirt from falling out over the edge 15, should the operator choose to lift the blade while so loaded.

If the load is to be transferred, the entire blade may be tilted rearwardly, to help retention, as it is lifted. If desired, the operator can continue, even after full loading, to push forwardly, whereupon the secondary plate 26 and brace plate 25 act similar to a conventional dozer blade, pushing soil before the unit.

When the dump point is reached, the loader blade is lifted, if not already elevated, and tilted forwardly as shown in FIG. 3. Generally simultaneously the assembly 21 is rotated approximately 90° clockwise from the position 43, FIG. 1. This causes a large portion of the load to be released both from the upper and lower portions of the blade. The loading assembly 21 is then rotated counterclockwise to fully sweep the blade inner surface 20 with the edge 31, dislodging and releasing the remaining load. The tractor is then ready to be backed for another pass and the blade attitude and loading assembly 21 returned to their initial positions.

It is to be understood that a similar arrangement to that described above may be adopted for use on pull type scrapers and other earth moving devices, essentially permitting two loads to be carried, one above and one below the plate 23.

It is to be further understood that, although certain forms of this invention have been illustrated and described, it is not be limited thereto except insofar as such limitations are included in the following claims.

I claim:

1. A boom mounted loader arrangement for excavator, said arrangement comprising:

a. a blade having a generally cylindrically shaped inner surface and a cutting edge; said inner surface having a central axis and being disposed at a radius therefrom; said blade being adapted for pivotal connection with said excavator;

b. a loading assembly rotatably connected with and supported by said blade for rotation about said central axis; said assembly including a generally flat plate disposed transversely within said blade, having first and second free edges extending generally 180° radially apart from said central axis, said first free edge being positioned outwardly of said central axis at a radius slightly less than the radius of said inner surface, whereby upon rotation of said plate relative to said blade, said first free edge sweeps said inner surface;

power means selectively pivoting said loading assembly with respect to said blade;

d. said second free edge being positioned outwardly of said central axis at a radius shorter than the radius of said first free edge; said second free edge being oriented toward and spaced apart from said inner surface during a ground scraping position, and defining a material receiving throat therebetween; and e. said first free edge of said plate being disposed forwardly of said throat in said ground scraping position whereby ground engagement with said blade cutting edge loosens terrain material and urges the same through said throat and upon an upper surface of said plate, said plate at least partially supporting a load of said material thereon while additional loose material is supported on the inner surface of said blade.

2. The loader arrangement as set forth in claim 1 wherein:

a. said loading assembly includes side plates positioned to restrict lateral spillage from said blade.

3. The loader arrangement as set forth in claim 1 including a. means bodily lifting and tilting said blade and loading assembly independently of said loading assembly rotation with respect to said blade.

4. The loader arrangement as set forth in claim 1 wherein:

a. said plate constitutes a primary plate; and including b. a secondary plate connected with said primary plate and extending substantially normally thereof; said secondary plate having a free edge disposed at a radius shorter than the inner surface of said blade and being spaced forwardly from said second free edge in said ground scraping position.

5. The loader arrangement as set forth in claim 4 including:

a. a brace plate connected with and extending between said primary plate and said secondary plate and having a forward surface thereof engaging and pushing additional loose material during a bulldozing condition.

6. The loader arrangement as set forth in claim 1 wherein:

a. said power means selectively pivoting said loading assembly with respect to said blade includes a motor connected with and carried by said blade, and power transmission means operably connecting said motor with said loading assembly.

* * * * *